US010172408B1

(12) United States Patent
Kelly

(10) Patent No.: US 10,172,408 B1
(45) Date of Patent: Jan. 8, 2019

(54) HELMET TO MINIMIZE DIRECTIONAL AND LOCALIZED FORCES IN THE BRAIN AND OTHER BODY PARTS BY MEANS OF SHAPE PRESERVATION

(71) Applicant: John G. Kelly, Albuquerque, NM (US)

(72) Inventor: John G. Kelly, Albuquerque, NM (US)

( * ) Notice: Subject to any disclaimer, the term of this patent is extended or adjusted under 35 U.S.C. 154(b) by 0 days.

(21) Appl. No.: 14/707,386

(22) Filed: May 8, 2015

Related U.S. Application Data

(60) Provisional application No. 61/990,296, filed on May 8, 2014.

(51) Int. Cl.
*A42B 3/12* (2006.01)

(52) U.S. Cl.
CPC ..... *A42B 3/125* (2013.01)

(58) Field of Classification Search
CPC ..... A42B 3/12; A42B 3/068; A42B 3/063; A42B 3/125; A42C 2/00
USPC ..... 2/410, 411, 412, 414, 425, 2.5
See application file for complete search history.

(56) References Cited

U.S. PATENT DOCUMENTS

| | | | | |
|---|---|---|---|---|
| 3,992,721 | A | 11/1976 | Morton | |
| 4,288,268 | A * | 9/1981 | Hartung | A42B 3/063 156/245 |
| 4,507,801 | A | 4/1985 | Kavanagh et al. | |
| 5,794,271 | A | 8/1998 | Hastings | |
| 6,065,159 | A | 5/2000 | Hirsh | |
| 6,446,270 | B1 | 9/2002 | Durr | |
| 8,613,716 | B2 | 12/2013 | Summit et al. | |
| 8,756,719 | B2 | 6/2014 | Veazie | |
| 2004/0117896 | A1 * | 6/2004 | Madey | A42B 3/12 2/411 |
| 2005/0015855 | A1 * | 1/2005 | Skiba | A42B 3/063 2/412 |
| 2005/0050617 | A1 | 3/2005 | Moore, III et al. | |
| 2005/0158554 | A1 * | 7/2005 | Wang | B32B 27/08 428/412 |
| 2007/0099524 | A1 * | 5/2007 | Porter | B32B 5/24 442/38 |
| 2007/0119538 | A1 | 5/2007 | Price et al. | |
| 2007/0220662 | A1 * | 9/2007 | Pierce | A42B 3/125 2/410 |
| 2008/0028499 | A1 * | 2/2008 | Skottheim | A42C 2/00 2/414 |

(Continued)

FOREIGN PATENT DOCUMENTS

| | | | |
|---|---|---|---|
| WO | 9605746 | A1 | 2/1996 |
| WO | 2012109381 | A1 | 8/2012 |
| WO | 2013134063 | A1 | 9/2013 |

*Primary Examiner* — Gloria Hale

(57) ABSTRACT

A method for protecting the human head during and after an impact. This is accomplished by fabricating a layer of material that fits precisely on each individual wearer's head, and yet is so rigid that upon impact, the head will not be allowed to significantly change shape or volume, even temporarily. The structure and properties of this protective layer can be easily adapted to most helmet designs. The preferred method of forming this protective layer is to map each wearer's head shape with laser scanning, and then form the layer by means of 3D printing. Said fitted and rigid layer in very close and uniform contact with each wearers head is called an SPDI shield. The SPDI label stands for "Shape Preservation During Impact".

20 Claims, 1 Drawing Sheet

(56) References Cited

U.S. PATENT DOCUMENTS

Figure 1:
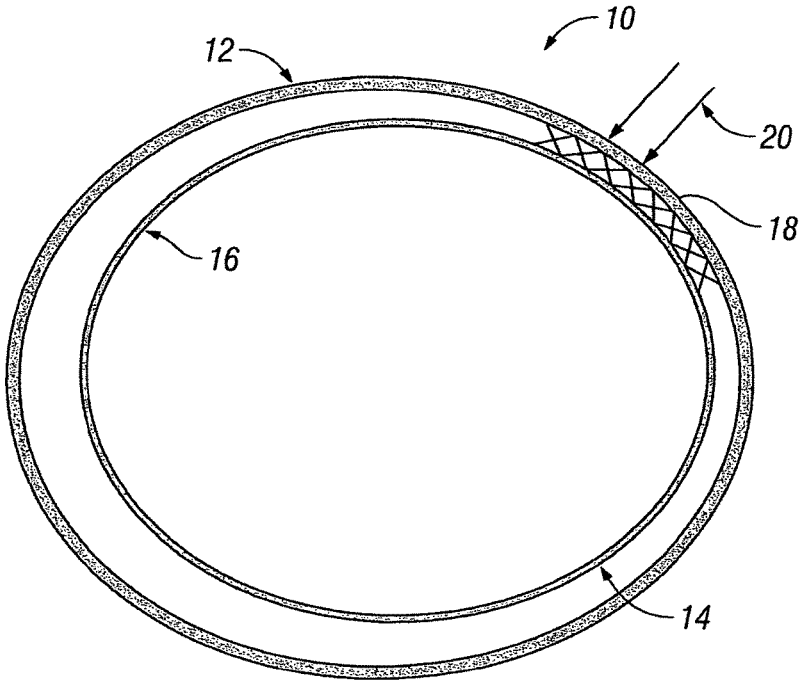
FIG. 1 (Prior Art)

| | | | | |
|---|---|---|---|---|
| 2010/0275337 | A1* | 11/2010 | Bhatnagar | F41H 1/08 2/2.5 |
| 2012/0017358 | A1 | 1/2012 | Princip et al. | |
| 2012/0186433 | A1* | 7/2012 | Braiewa | B32B 5/18 89/36.02 |
| 2013/0185837 | A1 | 7/2013 | Phipps et al. | |
| 2014/0081190 | A1 | 3/2014 | Summit et al. | |
| 2014/0201889 | A1 | 7/2014 | Pietrzak et al. | |
| 2014/0272267 | A1* | 9/2014 | Grunden | F41H 5/0485 428/102 |
| 2015/0047109 | A1 | 2/2015 | Grant et al. | |

* cited by examiner

HELMET TO MINIMIZE DIRECTIONAL AND LOCALIZED FORCES IN THE BRAIN AND OTHER BODY PARTS BY MEANS OF SHAPE PRESERVATION

CROSS-REFERENCE TO RELATED APPLICATIONS

This application claims priority to and the benefit of the filing of U.S. provisional Patent Application Ser. No. 61/990,296, filed on May 8, 2014, and the specification and claims thereof are incorporated herein by reference.

STATEMENT REGARDING FEDERALLY SPONSORED RESEARCH OR DEVELOPMENT

Not Applicable.

INCORPORATION BY REFERENCE OF MATERIAL SUBMITTED ON A COMPACT DISC

Not Applicable.

1

Not Applicable.

BACKGROUND OF THE INVENTION

Field of the Invention (Technical Field)

The present invention relates to methods and apparatuses for reducing injuries to the head from impact events.

Current commercial helmet designs provide many effective protections to their wearers, but more protection can be added by providing a very rigid and inflexible shield that is molded precisely to each wearer's head in a manner that keeps said head from changing shape or volume during an impact. This new technology is called an SPDI shield, which stands for "Shape Preservation During Impact". This two part requirement, stated above, is the core of the SPDI shield invention. The special advantage of said SPDI shield is not recognized or acknowledged yet by the those involved in the protective helmet industry. This is clearly the case because there is no prior art that shows evidence of attempting to apply or test the potential advantages of preserving a helmet wearer's head shape and volume during an impact arriving from outside said head surface. The generally accepted fact is that the said head exhibits the general properties of an incompressible fluid. That fact means that the physics of the force fields that reach said head protected by said SPDI shield will be different and more benign than the force fields encountered during an impact on said head inside any protective helmets currently on the market. Unfortunately, the ramifications of this accepted characteristic of said head is not well understood by the helmet design community because that community does not apply well known hydrodynamic theory and its implicit conclusions into defining how to best to identify helmet designs that incorporate the theory for improving said head protection.

The added advantage of the SPDI shield for protection is provided by taking the design of head shields in a different direction than has been the case in the past. The SPDI shield next to the head surface, must be made of light, but strong material, that will not crack, flex or fail in other ways during and after an impact, thereby preventing the head from changing shape or volume during that crucial period. The point here is that if the SPDI shield does not protect the head from changing its shape or volume during and after an impact, it has failed to adequately protect the wearer. Even if the inner shield of typical helmets recovers its original shape after impact, it is too late, because it will already have delivered unbalanced forces to the head that enter through or are generated in any outer layers of the helmet. Any such outer layers are not part of this invention, but they are still likely to further benefit the said performance of said protective SPDI shield in many activities such as in sports, military action, construction and in emergencies. Also, any outer layers may also stretch out the time profile of the impact enough to reduce the hydrostatic shock generation amplitude delivered to the SPDI shield and to the head.

In the public literature on helmet design, the authors frequently refer to "rigid" layers in helmets. But the term "rigid" is not being applied in a manner that helps in judging the effectiveness of the helmet design in the protection of the head. Usually, in practice, the rigid layer is separated from the wearer's head by additional padding or space to make an ill fitting helmet be more comfortable. But, as mentioned, that arrangement with added padding next to said head surface compromises the intended protection that can be provided by the SPDI invention. In order to make the term "rigid" useful, "rigid" must be redefined to mean that during impacts, up to certain maximum limits of forces that reach the head, how much change in shape and/or volume can be allowed from an impact? (Obviously, no material can be absolutely rigid.) The answer depends on two critical factors. First, how well must said SPDI shield, next to said head, fit each wearer's head before an impact? Second, how rigid must the SPDI shield be to adequately protect said head during said impact? The material itself is not as important as the function of preserving the head shape and volume during and after an impact.

A relevant example of what can happen is the following. If a rigid layer, next to the head surface, does not fit well before an impact arrives, and is in place on said head, said rigid layer can do more harm than good by causing dents in said head. Note: a main reason for requiring protection both during and after impact is that if the said head becomes distorted by the impact, there will likely be rebound effects inside the head that can cause additional effects that can cause additional damage.

A significant fraction of head damage is not simply caused by the magnitude and direction of said forces applied to the head, but by the localized and unsymmetrical transport of those forces to said head when said head is allowed to change shape and volume during an impact. Note: The said SPDI shield should cover as much of said head as is practical, to be most effective, as long as said SPDI shield is still compatible with its intended function. For example, a helmet generally cannot cover the eyes. In addition, rotation from glancing blows must be addressed.

Furthermore, said head will act much like an incompressible fluid if it is confined by a tough and inflexible shield that matches the head of the wearer with high precision, as with said SPDI shield. In that case, the forces reaching said fixed volume and shape of said head will be dominated by the remaining hydrostatic forces. Most of the unbalanced and shear forces that may be impinging from outside said SPDI shield will not be transported through to the said head. Therefore, because of the fact that said head responds like an incompressible fluid, the dominating hydrostatic forces will be transmitted throughout the entire head almost instantaneously and uniformly, thereby greatly reducing the asymmetry and variability vs local position in any force fields arriving in or generated in the said head. All of this follows from the proper application of long established hydrodynamic theory that explains the nature of hydrostatic forces. Brain cells should not be easily affected by this uniform increase in pressure. The brain tissue should, therefore, be modeled mostly as a porous, fluid-saturated, nonlinear solid with very small volumetric (drained) compressibility. The point here is that even if said brain density has some variation over the brain volume, like an egg does, helmet designers cannot change that fact. Therefore, the only way to improve the protection of said head, beyond that provided by the conventional inner layer helmet designs, is to make the shield inner layer, that is against the head surface, match the head precisely and not change shape or volume during impact Note: Yet another example of the usefulness of hydrostatic forces is in hydraulic brake systems. Rigid pipes filled with incompressible fluids, like most oils, will transport the force on the brake pedal almost instantaneously to the brakes, even if the brakes are separated a distance from the peddle. All this is possible because there is effectively just an increase in pressure, and not as much localized variation of forces that could tear brain tissues.

There are a multitude of helmet designs in the public domain that describe proposals for new features that can be added to existing models, but these proposals often lack the application of underlying natural principals to help guide the designers. For example, it is fairly evident that an accurately fitted and stiffened inner shield placed against the head surface may spread out the impact over a wider area, but that obvious fact alone does not provide enough guidance for the actual engineering that must be done to best achieve the maximum head protection. This lack of guidance has generated a wide range of advocated helmet features that are often contradictory. Two examples are the following. First, some designers advocate a "rigid" foam structure that can be exactly fit to each wearer's head to provide energy absorption and comfort. But that feature fails to protect the head from the distortion caused by the a collapse of the foam or pad during an impact. Second, a hard inner layer, next to said head surface has been used in some manufactured helmet systems to fit say 6 standard head sizes, (such as small, medium and large), and then fitted to each wearer's head with pads and straps. Neither feature will prevent the head from being distorted during an impact. Also, little guidance is provided in typical specifications of the rigidity, failure levels, flexibility, time response during impact. Consequently, helmets are usually compared against each other, rather than their relative ability to protect the head.

Accelerometers cannot sample every small volume in the head, and, therefore, are unlikely to provide an adequate measure of potential for head damage. The inventor of the SPDI shield contends that head damage will be minimized, if the SPDI shield is in place, and proper accounting is taken of the unbalanced and shear forces that will be strongly attenuated by the SPDI shield before they reach the said head. Thus, natural law is used to advantage instead of as a barrier to safety. Furthermore, all parts of the said head, (along with said SPDI shield itself) will tend to accelerate together, because said head shape and volume is preserved, and tearing of said head tissue will be reduced.

BRIEF SUMMARY OF THE INVENTION

The present invention is of a protective shield, such as a helmet, for the human head, and a concomitant method that preserves the shape and volume of said head during and after impacts. First, the SPDI shield next to the head surface, is made of materials that are very rigid, inflexible and will not crush, crack or otherwise fail when subjected to the limiting forces defined for the intended application. Thereby the damage from the impact will be minimized for the helmet design. Failure in this case means that the SPDI shield, next to the head surface, does not prevent said head from changing shape or volume, even temporarily, as a result of impact. Second, to accomplish this task, the SPDI shield must also be fabricated to fit each wearer's head to a much higher degree of accuracy than is used in conventional inner shields or required by existing standards, such as ASTM standard F1446 titled "Standard Test Methods for Equipment and Procedures Used in Evaluating the Performance Characteristics of Protective Headgear." An embodiment of this application is the fabrication of a football helmet with an inner layer, the SPDI shield, next to the head of a wearer that preserves the head shape during and after an impact. This means that unbalanced and shear forces will be significantly attenuated before reaching the head. The method is called SPDI which stands for "Shape Preservation During Impact."

Further explanation of the applicability of the present invention and of known and implied hydrodynamic phenomena associated head protection devices are set forth in part in the detailed description to follow, taken in conjunction with the accompanying drawings, and in part will become apparent to those skilled in the art upon examination of the following, or may be realized and attained by means of the instrumentalities and combinations particularly pointed out in the claims.

BRIEF DESCRIPTION OF SEVERAL VIEWS AND DRAWINGS

The accompanying drawings, which are incorporated into and form a part of the specification, illustrate one or more embodiments of the present invention and, together with the description, serve to explain the principles of the invention. The drawings are only for the purpose of illustrating one or more preferred embodiments of the invention and are not to be construed as limiting the invention. In the drawings:

FIG. 1 illustrates a typical prior art helmet design; showing an inner layer that is placed against the head surface between 14 and 16, and also showing the positioning of typical outer layers and a collapsed cross hatched region where an exterior force 20 is striking the helmet.

Figure 2:
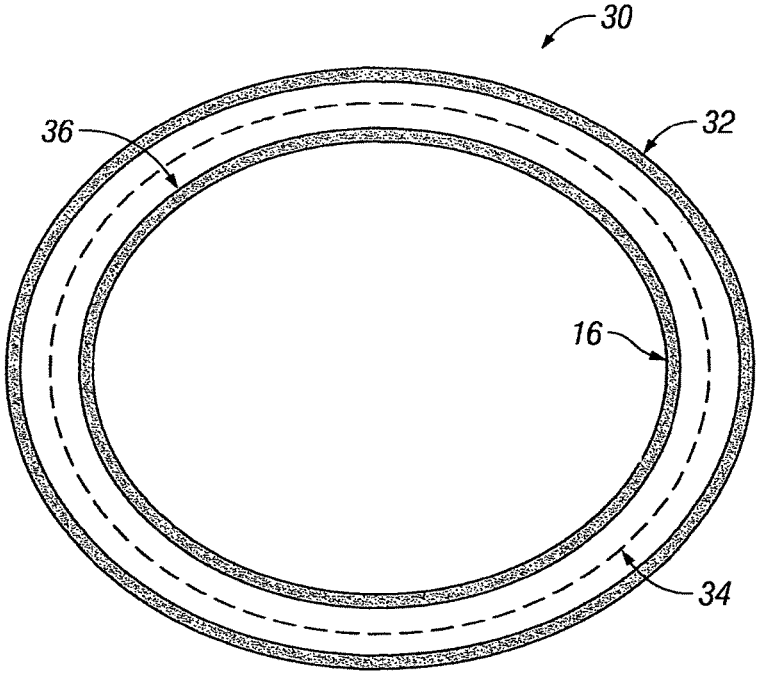

FIG. 2 Illustrates an embodiment of a typical helmet design of the present invention that would incorporate the SPDI shield 16 as it would be placed within other features incorporated in typical helmet structures, such as rotation dampers 34 and cushions. Note: Soccer players who make "headers" may benefit very much from a helmet incorporating only the SPDI shield because they could still maintain the control of the ball.

DETAILED SPECIFICATION DESCRIPTION AND FORMING OF HELMETS USING SPDI

Bighorn sheep are designed by nature to butt heads with all their might, but their skulls are strong enough to withstand the resulting forces without frequently delivering serious damage to their small brains compared to human brains. Their heavy skulls will not change shape very much during impact.

Humans took a different evolutionary path, and did not at first use their heads as weapons. Possibly 500,000 years has been too short a time to develop hard heads. Instead, we have developed large and vulnerable brains. The whole head is quite vulnerable to failure, including the skull which is made up of plates that can be flexed and fractured. These facts provide strong incentives for placing a second "skull" like layer just outside the one we have inherited.

As discussed above, many current helmet designs rely on materials that compress, crush, or crack or otherwise fail, to cushion and drain energy from impacts to the head. But beyond the point where the cushioning material begins to transmit unbalanced and localized forces that distort the head shape, the protection begins to break down. Example: if a sponge becomes highly compressed, it will transmit the remaining (and potentially very localized) impact forces on toward the head. An example 10 is shown in FIG. 1, with a hard outer layer or shell 12, intermediate collapsible cushion and rotation damper 14, head surface 16, collapse zone 18 and impact forces 20.

The tough inflexible SPDI Shield next to the head surface should be coupled with the typical, and often patented, outer layers now used on some modern helmets, an intermediate layer 34 with appropriate dampers for mitigating linear and rotational forces transmitted from an outer shell. Inside the head the specific responses will very much depend on the geometry and mix of the tissues that act as incompressible and/or compressible materials.

The SPDI shield of the invention described here is compatible with conventional designs for the outer cushioning, rotation damper and outer shell helmet models on the market, and should generally be used with them, except perhaps in soccer.

Rotational forces can still be a problem for helmets with the fitted SPDI shield discussed above. Therefore. if the rotational force mitigation structures recommended by the authors of other patents and other literature turn out to be proven effective in reducing head damage, it will be advantageous to use these technologies outside the SPDI shield of the present invention. In fact, said SPDI shield should improve the performance of any rotation damper by helping to decouple the head from rotational forces. The adaptation of the said SPDI shield should be easily engineered by anyone skilled the design of protective helmets. In this case, "skilled" implies a basic knowledge of hydrodynamic theory. The objective is to leave the head, the SPDI shield and the inner portion of the rotation damping layer behind in alignment with the head, if the outer layers start rotating about the center of gravity of the head as a result of an exterior impact at an angle. Thereby rotational forces will be reduced before reaching the head, as is well known.

High precision measurements of the head surface geometry and the openings necessary for neck, face and ears must be obtained in three dimensions. This can be accomplished, for example by casting or by scanning. This task must be done for each wearer.

A typical method of casting is to make a negative plaster or plastic cast, and then to make a positive cast upon which said SPDI shield can be built. For example, layers of fiberglass cloth permeated with epoxy or other binders can be built up until the needed strength and rigidity can be obtained. This method has been used to make castings for decades, and, was well described by Hartung, U.S. Pat. No. 4,288,268. But crucially for this helmet application, he did not specify how well his protective layer should fit each wearer's head.

A 3D laser (photogrammetry) scan of the head can be made. Then a positive mold can be made by machining, 3D printing, or other additive manufacturing. 3D scanning together with 3D printing may be the most economical way to manufacture the SPDI shield.

Note that laser scanning of infant heads has become an effective step for skull shape correction helmets. In that case, the helmets utilizing the scanning data are then used to slowly correct the shape of the infant's head as he/she grows. (This head shape modification application is obviously the opposite of shape preservation.)

Fiberglass, layered with epoxy or resin, is light and strong, and in this embodiment can be used for an SPDI shield. However, other materials which may have superior properties, are more adaptive, and are less expensive to fabricate on a custom basis, may be employed. Suitable materials that can be employed in 3D printing, using scanning data, could improve performance overall at a lower cost. Very complex structures can now be made by 3D printing with a variety of materials.

Note that more protection can be provided by extending said SPDI shield over a larger area of the head in a way that makes the helmet more difficult to put on or take off—this complication can be reduced by coupling stepped SPDI shield parts together with latches or other means, compatible with any intermediate layer. This can be done because the SPDI shield is made of a tough, inflexible material.

A detailed example of a viable fabrication procedure, using fiberglass and epoxy, is here provided. Make a mold in plaster of the head to be protected. This cast is called a negative cast. Next, lubricate the inside surface of said negative cast with a substance that will allow separation of the negative and positive casts after the positive cast is set. Pour a new batch of plaster into the negative cast cavity. Before the new plaster sets, put a stake of wood or other material into the plaster. This stake must stick out of the setting plaster far enough to be used as a handle for mounting said positive cast on a fixture. Said fixture can be used to support the positive cast when the SPDI shield is being constructed. Note: It is very important that specifications, as to how the SPDI shield is constructed and will perform in use be designated, i.e. shape preservation during impact. The SPDI shield inner surface should not deviate by more than 1 mm away from the original head shape, preferably, along any 5 cm long contour line along said head surface, when said SPDI shield is in proper position on said wearer's head during the specified limits on impact intensity, time history and geometry. Also, said SPDI shield should not change shape by more than 1 mm along any 5 cm long contour along the inner surface of the original SPDI shield. Current standards do not require these types of specifications. Following these types of specifications will permit testing of the SPDI shield without using a living human head.

Next, remove the negative cast. Mount the positive cast so that said SPDI shield can be formed upon it. In this situation, the positive cast makes it feasible to build said SPDI shield inner surface on the specified shape and size as the head to be protected.

Note: One can add plaster or other materials around the edges of the positive cast so that a flair will be added to said SPDI shield for comfort at its edges.

Prepare the fiberglass sheets required to form said SPDI shield and the needed amount of epoxy for the assembly. Lubricate the positive cast so that it can be separated from said SPDI shield once the setting is complete. Lay a fiberglass sheet over the cast. Cover the said sheet with a layer of epoxy that is spread out liberally over the whole surface and worked into the fabric completely. Leave no bubbles. Lay the next sheet on, and repeat the epoxy application step.

Again, leave no bubbles. Continue until the required number of fiberglass-epoxy layers has been reached. (This task is best accomplished before the epoxy hardens and cannot be worked into the sheet layers well.) The fiberglass-epoxy should then be allowed to set before any trimming is done such as cutting, filing, filling gaps with epoxy, and sanding.

Note: The above detailed example in no way limits the manner of fabrication by which said SPDI shield can be constructed, as long as said SPDI shield requirements are met.

FIG. 1 illustrates how a typical inner layer next to the head, for helmets, is preferably placed with respect to any intermediate and outer layers of conventional helmets. FIG. 2 represents a horizontal cross section of a helmet 30 just above the ear line, comprising hard, rigid, outside shell 32, rotational slip boundary 34 and said SPDI shield 16. Again, only the SPDI shield is the core of the invention.

Accordingly, said SPDI shield invention is a device whereby damage from impacts to a helmet wearer's head, can be further reduced from the level of protection provided by conventional shields. The SPDI shield must fit each wearer's head precisely, and not allow the outer surface of said head to change shape, significantly, during and after an impact. This means that any damage that can be caused by a change in head shape during and after an impact will be significantly reduced.

The added protection is likely the best that can be done because, in the case of heads in particular, the head cannot be further protected by somehow adding something to the inside of the head.

The shape and volume preservation of a wearer's head during an impact on the said helmet can only be accomplished if the following characteristics of said SPDI shield, right next to said wearer's head, can be obtained. (1) The material of which said SPDI shield is comprised is shaped precisely to the said wearer's head. (2) The SPDI shield has to be rigid, inflexible and tough enough to meet the requirements determined by the environment for which it will be used. e.g., the maximum force field, and its other characteristics, for which said SPDI shield must not fail to preserve the original head shape and volume during an impact.

Since the head shape and volume are preserved through the impact period by the SPDI shield, and since said head responds primarily like an incompressible fluid, any unbalanced forces (such as local forces and sheer) will not be efficiently delivered to said head, and will only be weakly and uniformly coupled to said head, by any outer layers of the helmet. Instead, the forces and any acceleration will be delivered uniformly to the whole volume almost instantaneously. This means that if there are not serious variations of density or compressibility within the volume of said head, the forces on each component of said head will be approximately equalized everywhere in the head, and the damage will be minimized. Conventional protective helmets do not make adequate use of these hydrostatic phenomena.

The SPDI shield of the invention overcomes the disadvantages of using compressible layers right outside of said head surface in an attempt to protect said head, and make it more comfortable when the initial helmet shape does not provide an adequate fit.

Compressible, flexible, crushable or collapsible substances are not suitable for said SPDI shield, because they will not preserve said head shape and/or volume during impact.

Maintaining the head shape during the impact raises the threshold level for exterior forces that can damage the head and brain.

Makers of conventional helmets often use the word "rigid" in their descriptions, then place a flexible or collapsible layer next to the head for comfort. But since no substance in nature is perfectly rigid, the term must be accurately defined to be meaningful. However, a precisely fitted SPDI shield, has the potential for being not only very comfortable, because of the good fit, but also to stay in place relative to said head where it can continue to provide enhanced protections. No cushions are needed or required between the SPDI shield and the head.

Low density materials are preferably used in said SPDI shield to help reduce nonuniform accelerations, if these materials are strong and rigid.

Said SPDI shield will not tend to transport an unbalanced or shear force to the head being protected. That is exactly what should be sought. The objective is to minimize the unbalanced, position dependent, energy absorbed and ultimately delivered to said wearer's head. Instead, said SPDI shield will transfer much of the potentially damaging energy back to the outer helmet layers where it will be absorbed. This transfer is made possible by "shape preservation" through the impact period. Since all parts of said head will tend to move or accelerate together, there will be a much reduced amount of damage done to said head by the impact. In fact, if said SPDI shield is very rigid, much of the force entering said SPDI shield material from the impact side will be diverted around to the opposite side where the back surface will start moving away from any shock forces that can reflect back into said head.

The said SPDI shield can easily be adapted to conventional helmets, with minor modifications, by those skilled in helmet design engineering.

Even if said SPDI shield can only extend over a restricted area of the head, the fact that a portion of the impact area may be spread over a larger area than that provided by collapsing cushions, or other outer layers, will still provide added protection to said head, even if the nature of the impact forces is more limited and omnidirectional.

The SPDI shield can be made quite thin, perhaps about 5 mm. Also, it can be easily be adapted to conventional helmets by those skilled in the art of helmet design and fabrication.

The fact that said SPDI shield can be thin, means that the size of said helmet does not have to be made significantly larger than is typical, in the helmet design field, to accommodate said SPDI shield technology.

When the SPDI shield is in proper position on the wearer's head so that it is in close contact, there should be no significant separation between said head surface and the inner surface of said SPDI shield over any 5 cm long contour line of the head surface, with the following exception. Small holes or channels in said SPDI shield can be added for skin breathing and comfort, provided said holes or channels are less than 1.5 mm wide and are separated by 3 mm or more.

There is no helmet presently on the market that preserves the head shape and/or volume during impact as well is demanded by said SPDI shield. This is because the hydrostatic forces that will dominate the force field in said head are not adequately accounted for in conventional protective helmet designs or in the relevant ASTM or other safety standards.

In the text above, the use of the word "helmet" may be taken as including a device for protecting body parts other than the head, or vice versa, depending on the context.

Although said SPDI shield invention has been described in detail with particular reference to these preferred embodiments, other embodiments can achieve the same results.

Variations and modifications of the present invention will be obvious to those skilled in the helmet design art, and is intended to cover in the appended claims all such modifications and equivalents. The entire disclosures of all references, applications, patients and publications cited above are hereby incorporated by reference.

What is claimed is:

1. A helmet for protecting a human head of a wearer from impacts and blows, said helmet comprising:

a substantially rigid shell constructed of shape preserving material configured to fit about a head of a wearer so that said rigid shell conforms to said wearer's head and a surface of said wearer's head with no more than 1 mm variation from the surface of said wearer's head over any 5 cm extent between the shell and said wearer's head surface, and whereby incompressibility and inflexibility of the rigid shell when struck by an impact or blow protects a wearer's head and brain therein by substantially preventing a change of the wearer's head shape.

2. The helmet as claimed in claim 1 additionally comprising any of a cushioning layer around an exterior surface of said rigid shell and/or a hard outer layer around the exterior surface off, but separate from the shell.

3. The helmet as claimed in claim 1 additionally comprising a rotation damper located between the exterior surface of the shell and the outer hard layer.

4. The helmet as claimed in claim 1 wherein the rigid shell of shape preserving material comprises at least eight total alternating and stacked layers of fiber glass and epoxy.

5. A helmet for protecting a human wearer's head from impacts and blows, said helmet comprising:

a substantially rigid shell configured to fit closely to the wearer's head;

said rigid shell configured to fit closely with no more than 1 mm variation from the wearer's head over any 5 cm extent along the surface of the wearer's head;

a hard outer layer around an exterior surface of, but separate from, the shell; and a rotation damper located between the exterior of the shell and the hard outer layer;

whereby incompressibility, inflexibility and resistance to cracking of the shell when struck protects a brain in the wearer's head by substantially preventing change of a wearer's head shape.

6. The helmet of claim 5 wherein said helmet further includes a cushioning layer around the exterior of said shell.

7. The helmet of claim 5 and further wherein the substantially rigid shell comprises a plurality of fiberglass and epoxy layers.

8. The helmet of claim 6 and further wherein the substantially rigid shell comprises a plurality of fiberglass and epoxy layers.

9. A method of constructing a helmet for protecting a human wearer's head from impacts and/or blows, said method comprising:

measuring a wearer's head surface geometry for providing said helmet rigid shell with an opening for said helmet wearer's neck, face and ears by any one of:

a casting method by constructing a negative plastic cast or by a 3D laser photogrammetry scan;

constructing a positive mold head shape of said wearer's head utilizing the plaster cast or said 3D laser scan to thereby construct a positive mold by machining or 3D printing;

constructing the rigid shell using said positive mold and forming said SPDI shield inner surface so the inner surface does not deviate more than 1 mm away from the positive mold that represents said wearer's original head shape along any 5 cm long contour line extent along said positive mold head surface forming said SPDI shield inner surface on said positive mold cast;

lubricating said positive mold cast;

placing at least one layer of a first fiberglass sheet over the cast and covering a said sheet with a layer of epoxy spread liberally over an entire surface of said positive mold cast layer without bubbles between said fiberglass sheet(s) and said epoxy and thereby repeating the layering steps until the number of fiberglass sheet layers and epoxy have been reached;

allowing said epoxy to set;

after said epoxy is set, the formed rigid shell is trimmed by cutting, filling, filing and sanding said rigid shell with epoxy and sanding said epoxy covered rigid shell when dry.

10. A method of constructing a helmet for protecting a human wearer's head from impacts and/or blows as in claim 9, said method further comprising:

placing a rotational damper layer on said rigid shell layer and then placing an exterior layer over said rotational dampening layer.

11. A method of constructing a helmet for protecting a human wearer's head from impacts and/or blows as in claim 10, said method further comprising:

providing holes or channels in said rigid shell layers wherein said holes or channels are less than 1.5 mm wide and are spaced 3 mm or more part.

12. A method of constructing a helmet for protecting a human wearer's head from impacts and/or blows as in claim 11, said method further comprising:

providing holes or channels in said rigid shell layers wherein said holes or channels are less than 1.5 mm wide and are spaced 3 mm or more part.

13. A method of constructing a helmet for protecting a human wearer's head from impacts and/or blows as in claim 10, said method further comprising:

wherein the rigid shell of shape preserving material comprises at least eight total alternating and stacked layers of fiber glass and epoxy.

14. A method of constructing a helmet for protecting a human wearer's head from impacts and/or blows as in claim 10 and further wherein the substantially rigid shell comprises a plurality of fiberglass and epoxy layers.

15. The helmet as claimed in claim 1 wherein said rigid shell inner surface is configured so as to not deviate more an 1 mm away from said wearer's head shape prior to any said impacts or blows thereon.

16. The helmet as claimed in claim 1 wherein said rigid shell is configured so as to not change shape by more than 1 mm along any 5 cm long contour along the inner surface of said rigid shell prior to any impacts or blows thereon.

17. The helmet as claimed in claim 6 wherein said rigid shell inner surface is configured so as to not deviate more an 1 mm away from said wearer's head shape prior to any said impacts or blows thereon.

18. The helmet as claimed in claim 6 wherein said rigid shell is configured so as to not change shape by more than 1 mm along any 5 cm long contour along the inner surface of said rigid shell prior to any impacts or blows thereon.

19. A method of constructing a helmet for protecting a human wearer's head from impacts and/or blows as in claim 10 wherein said rigid shell inner surface is configured so as to not deviate more an 1 mm away from said wearer's head shape prior to any said impacts or blows thereon.

20. A method of constructing a helmet for protecting a human wearer's head from impacts and/or blows as in claim 10 wherein said rigid shell is configured so as to not change shape by more than 1 mm along any 5 cm long contour along the inner surface of said rigid shell prior to any impacts or blows thereon.

* * * * *